US006213466B1

(12) United States Patent
Rosen

(10) Patent No.: US 6,213,466 B1
(45) Date of Patent: Apr. 10, 2001

(54) CRASH-ACTION, VEHICLE RACING GAME AND METHOD

(76) Inventor: Max Rosen, 2 Maryann La., New City, NY (US) 10956

( * ) Notice: Subject to any disclaimer, the term of this patent is extended or adjusted under 35 U.S.C. 154(b) by 0 days.

(21) Appl. No.: 09/265,613

(22) Filed: Mar. 10, 1999

(51) Int. Cl.[7] ..... A63F 3/00

(52) U.S. Cl. ..... 273/236; 273/258; 273/244; 273/287

(58) Field of Search ..... 273/242, 243, 273/246, 248, 258, 259, 260, 262, 287, 282.1

(56) References Cited

U.S. PATENT DOCUMENTS 1,294,256 * 2/1919 George .
1,421,570 * 7/1922 Rod .
2,620,192 12/1952 Housley .
3,414,264 * 12/1968 Schriber .
3,656,757 4/1972 Carroll .
3,765,679 * 10/1973 O'Connell .
3,863,927 * 2/1975 Moritz .
3,929,337 * 12/1975 Hayes .
3,940,140 2/1976 Meyer et al. .
4,411,433 * 10/1983 Flynn .
4,470,602 * 9/1984 Reed .
4,534,566 8/1985 Ferris et al. .
4,563,011 * 1/1986 Ferris .
4,917,386 * 4/1990 Tozer .
5,139,267 * 8/1992 Trevisan .
5,221,084 * 6/1993 Stelmach .
5,259,623 11/1993 Kanelos, Sr. .
5,308,078 * 5/1994 Hatter .
5,452,893 * 9/1995 Faulk .

* cited by examiner

*Primary Examiner*—Benjamin H. Layno
*Assistant Examiner*—V K Mendiratta
(74) *Attorney, Agent, or Firm*—Kirschstein, at al

(57) ABSTRACT

A car racing game simulates a real racing event involving car crashes that help determine the winner of the race. Opposing cars line up at opposite ends of racing lanes and advance generally toward each other. The cars have wheels and roll along the lanes from one space to another. Each space is designed to prevent the cars from inadvertently rolling out of the space.

19 Claims, 2 Drawing Sheets

CRASH-ACTION, VEHICLE RACING GAME AND METHOD

BACKGROUND OF THE INVENTION

1. Field of the Invention

This invention generally relates to racing games and, more particularly, to head-to-head competitions in which direct confrontations between racers determine, by a combination of skill and chance, the winner of each competition.

2. Description of the Related Art

Racing games, in which participants line up at a starting area or line, advance generally in one direction along the same course or identical courses on a game board, and compete to be the first to cross over a finish area or line, have long been popular, competitive, board game activities for people of all ages, especially children. Obstacles along the course are provided to enhance game interest.

The most popular racing game typically includes cars. Examples of board games involving cars include U.S. Pat. Nos. 2,620,192, 3,656,757, 3,940,140, 4,534,566, 4,563,011 and 5,259,623.

Yet, experience has shown that racing car games do not realistically simulate the experience of a real car race in which crashes or confrontations occur between cars. There are board games like checkers or chess in which direct confrontations between opposing game pieces occur by one piece jumping over, or occupying the same place as, another piece. There are even board games such as exemplified by U.S. Pat. Nos. 3,929,337 and 4,470,602 in which dice oppose one another. However, in none of these games involving opposing game pieces, is the racing experience simulated.

SUMMARY OF THE INVENTION OBJECTS OF THE INVENTION

Accordingly, it is a general object of the present invention to provide a racing game, especially involving cars, which recreates the excitement of a real racing event.

More particularly, it is an object of the present invention to realistically simulate a race wherein crashes occur between cars to determine the outcome of the race.

Still another object of the present invention is to provide a novel car racing game in which the players can use toy vehicles from independent toy car collections as the game pieces.

It is yet another object of the present invention to provide a car racing game with crash-action events that dictate the progress of play.

FEATURES OF THE INVENTION

In accordance with this invention, one feature, briefly stated, resides in a crash-action racing game that includes a plurality of first movable playing pieces, or racers, especially wheeled vehicles, for a first player; a plurality of second movable playing pieces, or racers, especially wheeled vehicles, for a second player; and a game board on which the racers are movable.

The game board has a pair of opposite end regions spaced apart along a longitudinal axis, a pair of opposite side regions spaced apart along a transverse axis that is generally perpendicular to the longitudinal axis, and a plurality of racing lanes. Each lane extends along the longitudinal axis between the end regions. The lanes are arranged in mutual parallelism along the transverse axis between the side regions. Each lane has a first starting playing position adjacent a first of the end regions, for accommodating a respective first racer upon beginning game play. Each lane also has a second starting playing position adjacent a second of the end regions, for accommodating a respective second racer upon beginning game play. Each lane further has a plurality of track playing positions between the first and second starting positions, for accommodating the first and second racers during game play.

During game play by the first player, each of the first racers is movable along the game board from the first starting playing position along the track positions to the second of the end regions. During game play by the second player, each of the second racers is movable along the game board from the second starting playing position along the track positions to the first of the end regions.

During the above-described movements of the first and second racers, a series of collision events is likely to occur. In the preferred embodiment, each collision event occurs when one of the racers of one of the players is moved to one of the playing positions that lies in the same lane as, and is immediately adjacent to, another of the playing positions that is already occupied by one of the racers of the other of the players.

The game includes collision instruction means for instructing one of the players, preferably the one who has moved one of his racers and thus caused the collision event, to obey a game instruction. The game instruction dictates the course of the game. The player who enters one of the end regions first is awarded points, and the player who amasses the most points is declared the winner.

In the preferred embodiment of the game, the racers, as previously mentioned, are wheeled vehicles, such as cars, each having a vehicle body and four wheels for rollingly engaging the board. To prevent the vehicles from inadvertently rolling out of their respective playing positions during game play, detention means are provided for detaining the wheeled vehicles in their respective playing positions. The detention means preferably comprises a raised grid elevated above a playing surface of the board. The grid includes a plurality of speed bump ridges intersecting with a plurality of lane divider ridges. The speed bump ridges extend in mutual parallelism across all the lanes along the transverse direction. The lane divider ridges extend in mutual parallelism along the lanes along the longitudinal direction. The speed bump ridges and the lane divider ridges bound a plurality of the playing positions for confining the wheeled vehicles. Each ridge has an outer curved surface over which the wheels of the wheeled vehicles roll.

Alternatively, the detention means includes a plurality of shallow depressions, each depression being located at a respective playing position. Each depression is situated below the playing surface for receiving at least one of the wheels of the wheeled vehicle therein to confine the latter.

The game board, in its preferred embodiment, constitutes each end region as a generally planar, finish area which extends along the transverse axis between the side regions across the lanes. Each finish area is bounded by a finish line. A raised finish ridge extends along the finish line.

One of the side regions of the game board constitutes a generally planar, pit stop area for accommodating wheeled vehicles remotely from the lanes. A raised pit stop ridge borders the pitstop area. Another of the side regions includes winner circle areas for accommodating wheeled vehicles after they have rolled onto the end regions. The winner circle areas constitute first, second and third place zones for accommodating the wheeled vehicles that have rolled first, second and third, respectively, in order onto the end regions. A raised circular ridge borders each winner circle area.

The collision instruction means preferably includes a stack of selectable cards bearing the game instructions, for selection and compliance by one of the players, preferably the one who caused the collision event. The game board has a raised stack ridge that borders a stack area for holding the stack of cards before their selection, and a raised discard ridge that borders a discard area for holding cards of the stack after their selection.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
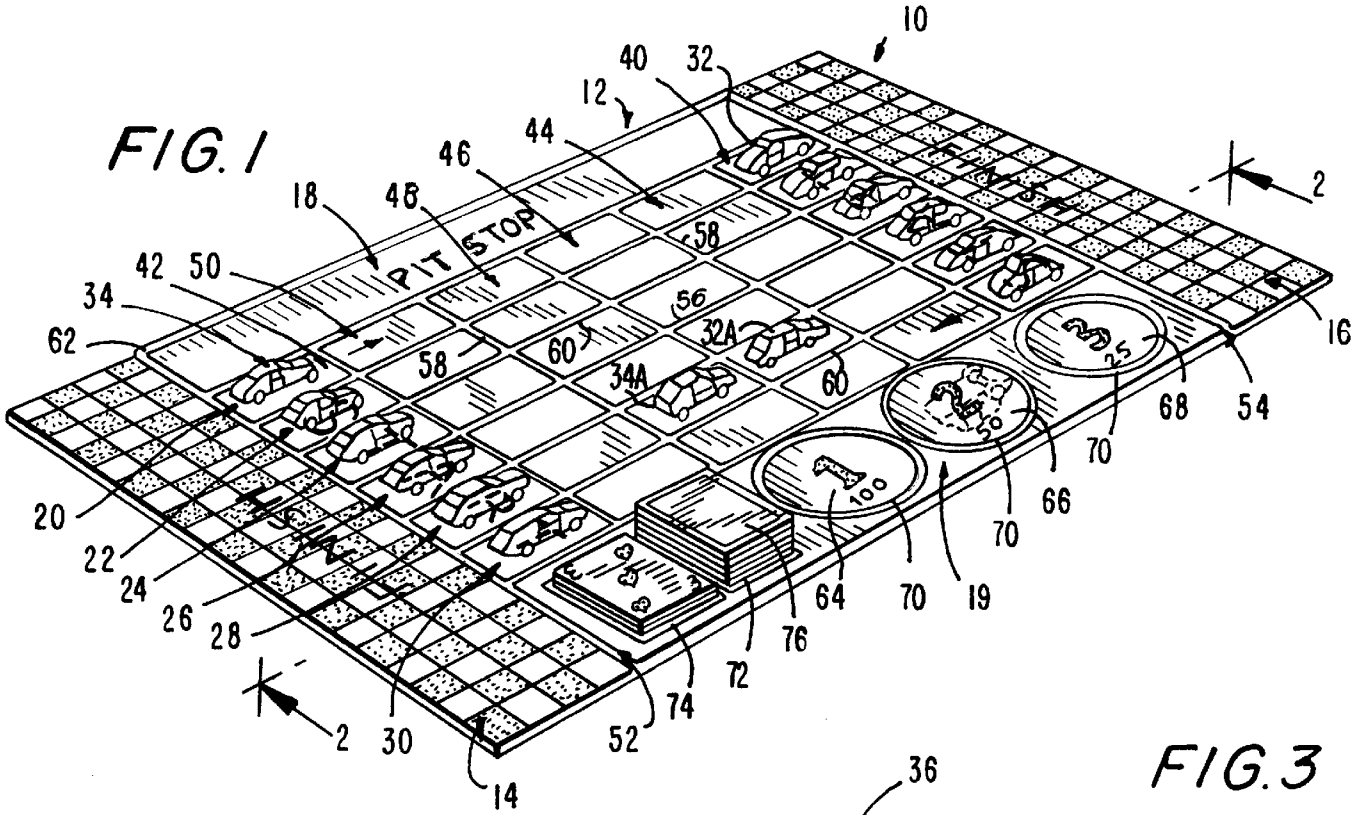
FIG. 1 is a perspective view of a racing game in accordance with this invention.

Referring now to the drawings, reference numeral 10 in FIG. 1 generally identifies a crash-action, racing game comprising a game board 12 having a generally planar, upper playing surface, a pair of opposite end regions 14, 16 spaced apart along a longitudinal axis, a pair of opposite side regions 18, 19 spaced apart along a transverse axis that is generally perpendicular to the longitudinal axis, and a plurality of racing lanes 20, 22, 24, 26, 28, 30, each lane extending along the longitudinal axis between the end regions 14, 16. The lanes are arranged in mutual parallelism in a side-by-side relationship along the transverse axis between the side regions 18, 19. Each lane has a plurality of playing positions successively arranged along the longitudinal axis. The playing positions are arranged in rows along the transverse axis.

Figure 3:
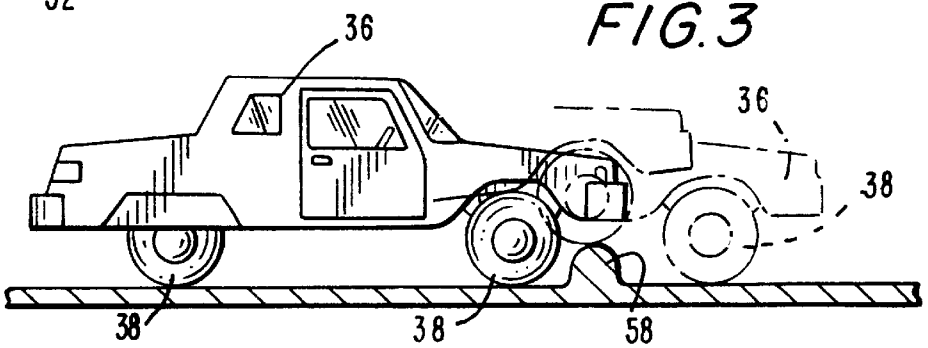
FIG. 3 is a side elevational, enlarged view of a wheeled vehicle in solid and phantom lines as it rolls over a speed bump ridge of the game of FIG. 1.
Figure 2:
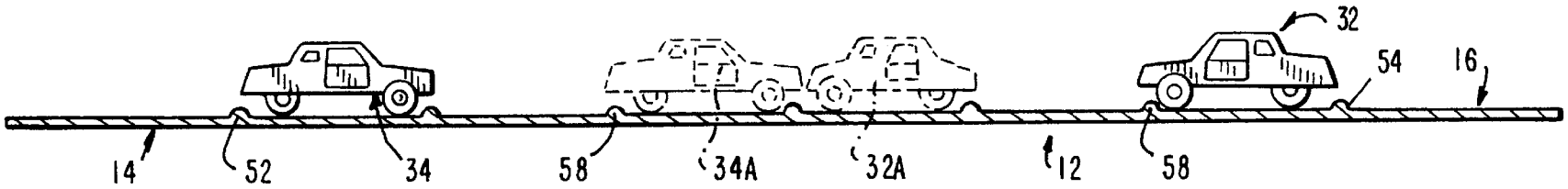
FIG. 2 is a sectional view taken on line 2—2 of FIG. 1.

The game 10 includes a first set of playing pieces or racers, especially cars 32, for a first player, and a second set of playing pieces or racers, especially cars 34, for a second player. As shown in FIG. 3, each car has a vehicle body 36 and four wheels 38, mounted for rotating movement on the body 36. Cars 32 may be differently colored, or bear a different identifying mark, than cars 34 to distinguish the cars belonging to each player.

As shown in FIG. 1, the cars 32 are initially lined up along the transverse axis in a first starting row 40 in which each car 32 occupies a first starting playing position in the respective lanes. The cars 34 are initially lined up along the transverse axis in a second starting row 42 in which each car 34 occupies a second starting playing position in the respective lanes. Each lane has a pair of cars 32, 34 at opposite ends thereof and facing one another. The playing positions between the starting positions are arranged along track rows 44, 46, 48, 50.

During game play, the cars 32 are individually movable by the first player from their starting positions in row 40 across the rows 44, 46, 48, 50 and 42 before entering the end region 14 by crossing over a first finish line 52. The cars 34 are individually movable by the second player from their starting positions in row 42 across the rows 50, 48, 46, 44 and 40 before entering the end region 16 by crossing over a second finish line 54.

The players take respective turns and are permitted to move any one of their cars to an adjacent unoccupied playing position. A car in one lane may move forward by one position in the same lane, or may move sideways by one position to adjacent lanes in the same row, or may move diagonally forward by one position to the adjacent lanes in the next row, provided that the position to which the car is desired to be moved is unoccupied by another car.

To prevent the cars from inadvertently rolling out of their respective playing positions during game play, a detention grid 56 is provided for detaining the cars. The grid 56 is elevated above the playing surface and includes a plurality of speed bump ridges 58 extending transversely in mutual parallelism across all the lanes, and a plurality of lane divider ridges 60 extending longitudinally in mutual parallelism along all the lanes. The ridges 58, 60 intersect one another to bound the playing positions, also called spaces, in which the cars are confined. The ridges bounding each space are out of contact with the car confined therein. Each ridge has an outer, curved surface, as shown in FIG. 3, over which the wheels 38 of a car roll during deliberate movement by a player. The ridges are high enough to prevent a car in one space from rolling inadvertently into another space.

The grid 56 may be integrally molded with the board, or a discrete component attached to the board. Preferably the board is made of cardboard stock, and the grid is made of a synthetic plastic material that is permanently attached to the board.

Before describing game play in detail, it will be noted that the end regions 14, 16 are marked as "finish" areas and bear a checkered pattern to simulate a checkered flag which is lowered during a real car race to designate the car that has won the race. Finish lines 52, 54 are formed as raised ridges.

Side region 18 is marked as a "pitstop" and serves as a holding area for the cars to simulate an area beside an auto racecourse where cars may be refueled or serviced during a race. A rectangular raised ridge 62 borders the pitstop area to retain the cars therein.

Side region 19 has "winner circles" for holding cars after they have finished the race. Circles 64, 66, 68 constitute first, second and third place zones for the cars which finished first, second and third, respectively. A raised circular ridge 70 borders each winner's circle. Each circle bears a numeral indicating the order of finish, as well as the number of points having been won as a result of the finish.

Side region 19 also has a raised, rectangular stack ridge 72 bordering an area for holding a stack of cards 76, and another raised, rectangular discard ridge 74 bordering an adjacent area for holding discarded cards from the stack. The purpose of the cards 76 is described below.

The finish line ridges 52, 54, the pitstop ridge 62, the circle ridges 70 and the stack ridges 72, 74 are preferably integral with and/or connected to the grid 56.

Returning to FIG. 1, game play generally proceeds by having the first player roll his cars 32, one space at a time, from the starting row 40 in one direction toward the end region 14, and by having the second player roll his cars 34, one space at a time, from the starting row 42 in the opposite direction toward the end region 16. The car which crosses the respective finish line 52, 54 first is awarded the first place winner's circle 64 and a predetermined amount, e.g., one hundred points. The second and third finishing cars are awarded the second and third place winner's circles 66 and 68, and a lesser amount of points, e.g., fifty and twenty-five, respectively.

During such game play, a series of collision events is likely to occur and, indeed, a player may deliberately initiate a collision event to advance his or her progress in the game. In the preferred embodiment, a collision event occurs when a car of one player is moved to a space that lies in the same lane as, and is immediately adjacent to, i.e., in the next row as, another space already occupied by a car of the other player. By way of example, representative car 32A in FIG. 1 has just moved from row 44 to row 46 in lane 28, and is thus immediately adjacent to representative car 34A which is in the next row 48. This simulated crash enables one of the players, preferably the player who initiated the crash, i.e., the player who moved car 32A, to draw one of the cards 76 and obey a game instruction printed thereon. The cards 76 have different instructions, as described below, which dictate the course of play.

In a preferred embodiment, the cards 76 are a set of fifty-two conventional playing cards having four suits of cards of thirteen cards in each suit. The following game instructions are to be followed upon picking a(n):

ACE Move the car initiating the crash to the first place winners's circle 64. If the circle 64 is already occupied, draw another card.

TWO Move the car initiating the crash to the second place winner's circle 66. If the circle 66 is already occupied, draw another card.

THREE Move the car initiating the crash to the third place winner's circle 68. This ends the race.

FOUR The car initiating the crash loses one turn, but stays in place. It cannot be moved until after the next move. A disabled car may be jumped over by the opponent.

FIVE The car initiating the crash loses two turns, but stays in place. It cannot be moved until after the next two moves. A disabled car may be jumped over by the opponent.

SIX Both cars involved in the crash are taken out of the race and put into the pitstop 18.

SEVEN The player whose car initiated the crash takes his opponent's car out of the race and puts it into the pitstop 18.

EIGHT The car initiating the crash is taken out of the race and put into the pitstop 18.

NINE The car initiating the crash is moved one space to the right or the left. If these spaces are filled, another card is picked.

TEN The car initiating the crash is moved one space forward diagonally. If these spaces are filled, another card is picked.

JACK The player whose car initiated the crash returns one of his cars from the pitstop to the starting row. If there are no cars in the pitstop, this turn is forfeited.

QUEEN The car involved in the crash is moved two spaces forward, sideways, or diagonally forward.

KING The car involved in the crash is moved one space backwards (straight or diagonally). If these spaces are filled, this turn is forfeited.

The cards 76 constitute a collision instruction means and, instead of using a conventional deck, a special set of cards with pre-printed instructions may be used. Also, the instructions can be printed on the game board, or on a separate sheet. In another embodiment, the collision instruction means may constitute a spinner, i.e., a rotary arrow that points to a particular game instruction after its spinning is completed. It will be appreciated that the above-described game instructions are exemplary, and that other instructions can be substituted for a card or spinner selection.

The object of the game is to collect a predetermined number, e.g., one thousand, of points by placing first, second, and/or third in a series of races. The collision events which simulate a real crash situation can advance or retard a player's process depending on the card drawn.

Each player starts with an equal number of their cars on the starting rows. Although six cars are illustrated for each player, less than six cars can also be used. Although six rows are illustrated on the game board, more or less than six rows can be employed.

The car which crosses the opposite finish line first is placed in the highest available winner's circle. When all three circles are filled, the score is tabulated, and another race is begun until the predetermined number is reached. The first place winner of each race begins the next race.

Figure 4:
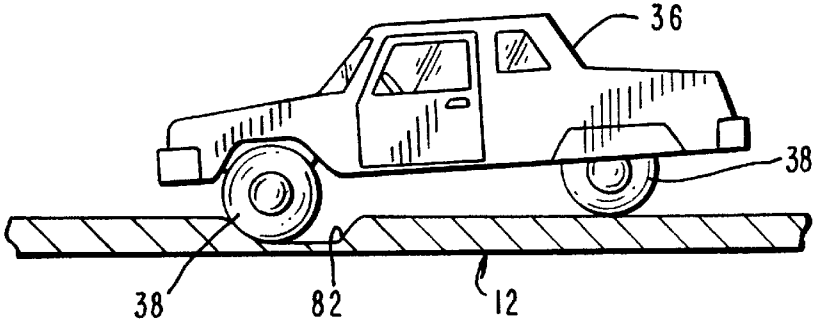
FIG. 4 is a side elevational, enlarged view of a wheeled vehicle partially received in a depression in accordance with a variation of the invention.

Rather than using a raised grid, FIG. 4 depicts another manner of detaining the cars in their spaces by providing a shallow depression 82 at each space. Each depression is situated below the playing surface and receives at least one, and preferably more than one, of the wheels of a respective car. Other detention means include a set of bumps or dimples to engage the wheels of each car and resist the wheels from rolling inadvertently. None of these detention means, however, prevents each player from rolling his car up and over a raised ridge and/or up and out of a shallow depression to advance his or her car toward the finish line.

As used herein, the racer can be configured as any playing piece, for example, a horse, a dog, a runner, a vehicle and, in short, any person, animal, or thing that can move on its own, or that can be driven. As previously discussed, it is preferred that vehicles having wheels be the playing pieces. Such vehicles may include cars, trucks, trains, etc.

The racing game of this invention has a special appeal for collectors of miniature vehicles, especially die-cast cars, because two collectors can play this racing game and compete not only for points but also for each other's collectable cars. By appealing to such vehicle collectors, the game manufacturer need not provide all or any of the vehicles with the game board, but instead, can rely on the players themselves to supply the vehicles from their own collections.

It will be understood that each of the elements described above, or two or more together, also may find a useful application in other types of constructions differing from the types described above.

While the invention has been illustrated and described as embodied in a crash-action, vehicle racing game and method, it is not intended to be limited to the details shown, since various modifications and structural changes may be made without departing in any way from the spirit of the present invention.

In another variant, the collision event may be defined differently. For example, the collision event may occur when the car of one player jumps over the car of another player. Still another modification resides in forcing the opposing player, i.e., not the one who initiated the crash, to select a card 76, and then to obey the game instruction on the selected card.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

What is claimed is:

1. A crash-action, vehicle racing game, comprising:

a) a plurality of first wheeled vehicles for a first player;

b) a plurality of second wheeled vehicles for a second player;

c) a game board having i) a pair of opposite end regions spaced apart along a longitudinal axis, ii) a pair of opposite side regions spaced apart along a transverse axis that is generally perpendicular to the longitudinal axis, iii) a plurality of vehicle racing lanes, A) each lane extending along the longitudinal axis between the end regions, B) the lanes being arranged in mutual parallelism along the transverse axis between the side regions, and C) each lane having a first starting playing position adjacent a first of the end regions, for accommodating a respective first wheeled vehicle upon beginning game play; a second starting playing position adjacent a second of the end regions, for accommodating a respective second wheeled vehicle upon beginning game play; and a plurality of track playing positions between the first and second starting positions, for accommodating the first and second wheeled vehicles during game play;

d) each of the first wheeled vehicles having wheels for rollingly engaging the game board during rolling movement from the first starting playing position along the track positions to the second of the end regions during game play by the first player;

e) each of the second wheeled vehicles having wheels for rollingly engaging the game board during rolling movement from the second starting playing position along the track positions to the first of the end regions during game play by the second player;

f) one of the wheeled vehicles of one of the players being rolled to one of the playing positions that lies in the same lane as, and is immediately adjacent to, another of the playing positions that is already occupied by one of the wheeled vehicles of the other of the players, to constitute a collision event during game play;

g) detention means for detaining the wheeled vehicles in each of their respective playing positions during game play to prevent the wheeled vehicles from inadvertently rolling out of their respective playing positions; and h) collision instruction means for instructing one of the players, to obey one of a set of different game sheet-printed instructions, upon the occurrence of the collision event.

2. The vehicle racing game of claim 1, wherein each end region constitutes a generally planar, finish area which extends along the transverse axis between the side regions.

3. The vehicle racing game of claim 2, wherein each finish area is bounded by a finish line.

4. The vehicle racing game of claim 3, wherein a raised finish ridge extends along the finish line.

5. The vehicle racing game of claim 1, wherein one of the side regions constitutes a generally planar, pitstop area for accommodating wheeled vehicles remotely from the lanes.

6. The vehicle racing game of claim 5, wherein a raised pitstop ridge borders the pitstop area.

7. The vehicle racing game of claim 1, wherein another of the side regions includes winner circle areas for accommodating wheeled vehicles after they have rolled onto the end regions.

8. The vehicle racing game of claim 7, wherein the winner circle areas constitute first, second and third place zones for accommodating the wheeled vehicles that have rolled first, second and third, respectively, in order onto the end regions.

9. The vehicle racing game of claim 7, wherein a raised circular ridge borders each winner circle area.

10. The vehicle racing game of claim 1, wherein the playing positions are arranged in linear rows along the transverse direction, and in linear columns along the longitudinal direction; and wherein each first starting playing position is situated along a first starting row for the first wheeled vehicles; and wherein each second starting playing position is situated along a second starting row for the second wheeled vehicles; and wherein the first starting row is located adjacent the first of the end regions; and wherein the second starting row is located adjacent the second of the end regions.

11. The vehicle racing game of claim 1, wherein the game board has a generally planar playing surface, and wherein the detention means includes a raised grid elevated above the playing surface; and wherein the grid includes a plurality of speed bump ridges extending in mutual parallelism across all the lanes along the transverse direction, and a plurality of lane divider ridges extending in mutual parallelism along the lanes along the longitudinal direction; and wherein the speed bump ridges and the lane divider ridges bound a plurality of the playing positions for confining the wheeled vehicles.

12. The vehicle racing game of claim 11, wherein the ridges bounding each playing position are spaced away from, and out of contact with, the respective wheeled vehicle confined therein.

13. The vehicle racing game of claim 11, wherein each ridge has an outer curved surface over which the wheels of the wheeled vehicles roll.

14. The vehicle racing game of claim 1, wherein the game board has a generally planar playing surface, and wherein the detention means includes a plurality of shallow depressions, each depression being located at a respective playing position and being situated below the playing surface for receiving at least one of the wheels of the wheeled vehicle therein.

15. The vehicle racing game of claim 1, wherein the collision instruction means includes a stack of selectable cards, each card bearing one of the game instructions, for selection and compliance by the player who caused the collision event.

16. The vehicle racing game of claim 15, wherein the game board has a generally planar playing surface, and wherein a raised stack ridge borders a stack area for holding the stack of cards before their selection, and wherein a raised discard ridge borders a discard area for holding cards of the stack after their selection.

17. A method of playing a crash-action, vehicle racing game, comprising the steps of:

a) providing a game board with a pair of opposite end regions spaced apart along a longitudinal axis, and with a pair of opposite side regions spaced apart along a transverse axis that is generally perpendicular to the longitudinal axis;

b) arranging a plurality of vehicle racing lanes in mutual parallelism along the transverse axis between the side regions, each lane extending along the longitudinal axis between the end regions, each lane having a first starting playing position adjacent a first of the end regions, a second starting playing position adjacent a second of the end regions, and a plurality of track playing positions between the first and second starting positions;

c) positioning each of a plurality of first wheeled vehicles for a first racing player in the first starting position of at least some of the lanes upon beginning game play;

d) positioning each of a plurality of second wheeled vehicles for a second racing player in the second starting position of at least some of the lanes upon beginning game play;

e) rolling the first wheeled vehicles from the first starting position along the track positions to the second of the end regions during game play by the first player;

f) rolling the second wheeled vehicles from the second starting position along the track positions to the first of the end regions during game play by the second player;

g) causing a collision event during game play by rolling one of the wheeled vehicles of one of the players to one of the playing positions that lies in the same lane as, and is immediately adjacent to, another of the playing positions that is already occupied by one of the wheeled vehicles of the other of the players;

h) detaining the wheeled vehicles in each of their respective playing positions during game play to prevent the wheeled vehicles from inadvertently rolling out of their respective playing positions; and i) instructing one of the players, to obey one of a set of different game sheet-printed instructions, upon the occurrence of the collision event.

18. The method of claim 17, wherein each rolling step is performed by rolling a selected one of the wheeled vehicles from a current one of the playing positions to an adjacent one of the playing positions.

19. The method of claim 18, wherein the detaining step is performed by bordering each of the playing positions with a raised ridge that is elevated above the game board, and wherein each rolling step includes the step of rolling the selected one of the wheeled vehicles over, and in rolling contact with, the ridge.

* * * * *